US005887017A

United States Patent [19]

Arthur et al.

[11] Patent Number: 5,887,017

[45] Date of Patent: Mar. 23, 1999

[54] PANELIZED SPRAY-COOLED FURNACE ROOF

[75] Inventors: Mark Thomas Arthur, Lakewood, Ohio; Eric Bellwood, Kent, England

[73] Assignee: UCAR Carbon Technology Corporation, Danbury, Conn.

[21] Appl. No.: 722,362

[22] Filed: Sep. 27, 1996

[51] Int. Cl.[6] ..... F27D 1/12

[52] U.S. Cl. ..... 373/74; 373/73

[58] Field of Search ..... 373/71–74

[56] References Cited

U.S. PATENT DOCUMENTS

| | | | |
|---|---|---|---|
| 4,715,042 | 12/1987 | Heggart et al. | 373/74 |
| 4,815,096 | 3/1989 | Burwell | 373/74 |
| 5,115,184 | 5/1992 | Arthur et al. | 373/74 |

*Primary Examiner*—Tu Ba Hoang
*Attorney, Agent, or Firm*—Frederick J. McCarthy

[57] ABSTRACT

Spray cooled roof for a metallurgical furnace in the form of an assembly of separate hollow metal sections, each of which has a separate spray cooling system.

6 Claims, 5 Drawing Sheets

PANELIZED SPRAY-COOLED FURNACE ROOF

FIELD OF THE INVENTION

This invention relates to a spray cooled roof for a metallurgical furnace, particularly a submerged arc furnace for the reduction of metal bearing oxidic ores, such as titanium ores.

BACKGROUND OF THE INVENTION

Spray cooling of the roofs of metallurgical vessels hag been practiced successfully as disclosed in U.S. Pat. No. 4,715,042—Heggart et al; U.S. Pat. No. 4,815,096—W. H. Burwell; and U.S. Pat. No. 5,115,184—M. T. Arthur and F. H. Miner, which describe unitary, i.e. one piece roof construction. In some instances, roof sectors are fabricated separately and then joined to provide a final unitary roof Such roofs have been very effective with electric arc steel melting furnaces and other applications.

It has become important to provide spray cooling for submerged arc metallurgical furnaces in which an electrode penetrates a furnace charge containing e.g. metal bearing ore. The arc from the electrode submerged in the furnace charge produces the high temperatures required for reduction of the metal bearing ore, e.g. titanium bearing ore. The thermal conditions to which the furnace roof is exposed in a submerged arc furnace varies considerably from location to location which tends to make the design of a unitary spray cooled roof complex. Also, the roof for a submerged arc furnace tends to be larger in diameter than roofs for steel scrap melting furnaces. The present invention is directed to the particular requirements of a submerged arc metallurgical furnace.

SUMMARY OF THE INVENTION

The present invention is directed to a roof for a metallurgical furnace which comprises an assembly, of frusto-conical shape, which is formed of a plurality of separate, hollow metal sections arranged to be closely adjacent and define an inner opening through which an electrode can pass vertically downward into a metallurgical furnace. The outermost portions of the hollow metal sections define an outer, circular periphery of the cover assembly which is supported by the circular sidewall of the furnace. Each hollow metal section is separately removable and installable, and each hollow metal section contains spray means connected to a header within the hollow metal section for spraying liquid coolant on the surfaces of the hollow metal section heated by the furnace, in particular, the bottom surface of the hollow metal section. The header of each hollow metal section is independently provided with a source of coolant by way of a coolant supply conduit and at least one coolant drain conduit is provided to receive spent coolant from inside a hollow metal section. A support member is provided at the lowermost portion of the hollow metal section to removably engage a portion of the circular peripheral sidewall of the metallurgical furnace. Support means are provided to give individual vertical support for each of the hollow metal sections.

DETAILED DESCRIPTION OF THE INVENTION

Figure 1:
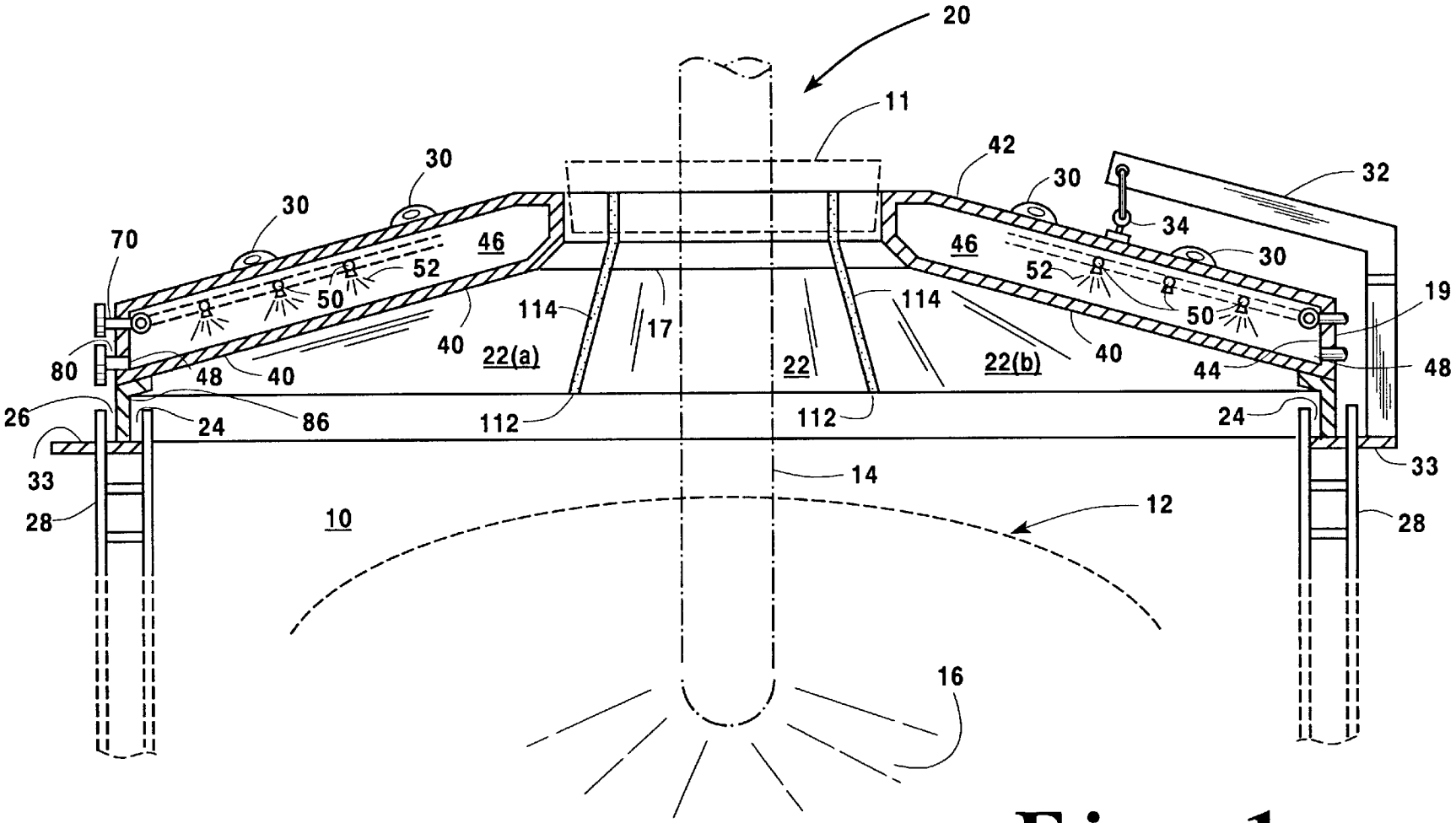
FIG. 1 is an elevation view, partly in section, of a spray cooled roof assembly in accordance with the present invention.

With reference to FIG. 1, a submerged arc electric furnace is indicated at 10 containing a solid charge 12 which includes a metal bearing ore, slag formers and reducing agent. An electrode 14 has its lower end submerged in the charge 12 and generates an arc 16 which heats charge 12 to high temperatures and promotes the reduction reaction which results in the recovery of metal from the ore and the formation of a covering slag. The thermal conditions in the furnace create extreme and varying stress on the lower side 40 of the roof assembly shown at 20 in FIG. 1.

In FIG. 1, the upwardly sloping cover assembly 20 of frusto-conical shape for submerged arc metallurgical furnace 10 having a circular peripheral sidewall 28 for enclosing metallurgical charge 12 comprises a plurality of separate removable closely adjacent, hollow metal sections 22–22 (*e*) which define an inner peripheral opening 17 through which electrode 14 can pass vertically downward into metallurgical furnace 10, the lowermost portions 86 of the hollow metal sections defining an outer periphery 19 of the cover assembly 20 which is supported by the circular sidewall 28 of the submerged arc furnace 10. A conventional removable "delta", indicated at 11, is used with the electric furnace.

Figure 4:
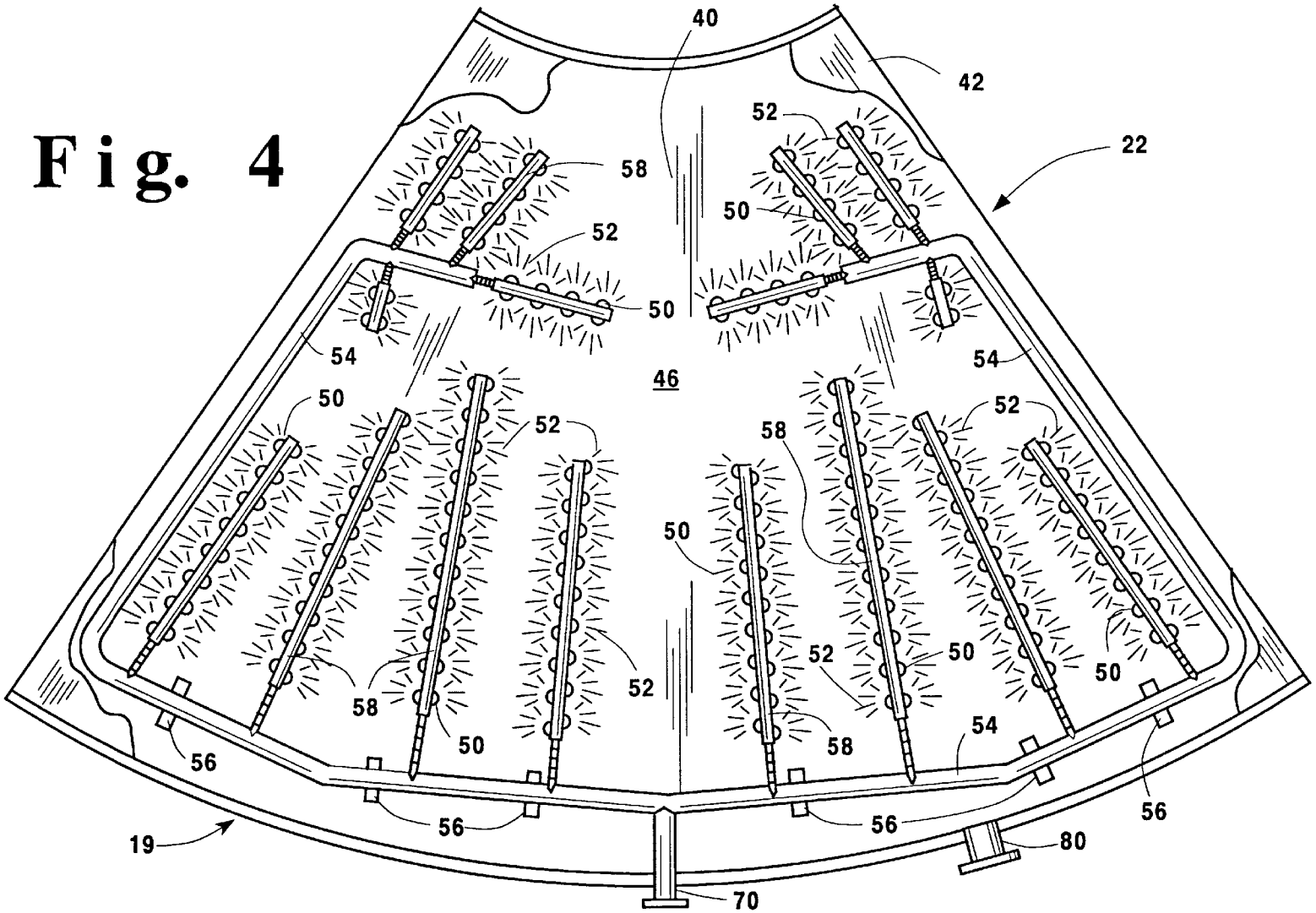
FIG. 4 is a fragmentary plan view of a hollow metal sub-assembly of a spray cooled roof assembly in accordance with the present invention.

With further reference to FIG. 1, and also to FIG. 4, the spray cooled furnace roof assembly of the present invention comprises a plurality, suitably up to four or more, separate, hollow metal sections 22–22(*e*) which are located closely adjacent over the furnace 10 in an upwardly sloping frusto-conical shape. Each of the hollow metal sections 22–22(*e*) are provided with a downwardly depending metal support member 24 which is seated in the circular peripheral channel 26 at the top of the circular sidewall 28 of furnace 10. The hollow metal sections 22–22(*e*) are separately installable, e.g. using an overhead crane (not shown) in connection with lifting brackets 30 to seat support members 24 in peripheral channel 26 of the furnace 10 in removable engagement with the sidewalls 28 of furnace 10. In the embodiment shown in FIG. 1, each metal section 22 is provided with a rotatable cantilever support arm 32 mounted on a shelf member 33 affixed to furnace wall 28. The support arm 32, as shown in FIG. 1, vertically supports hollow metal section 22(*b*) at bracket 34 affixed to hollow metal section 22(*b*). By way of example, a hollow metal section e.g. 22(*b*) is installed by an overhead crane or other device in the position shown in FIG. 1; cantilever arm 32 is swung into the position shown and engages the hollow metal section 22(*b*) at 34 as shown and the overhead crane can be removed. The remaining hollow metal sections are similarly installed. A hollow metal section 22–22(*e*) can be individually and separately removed, e.g. for inspection or replacement, by reversing the installation procedure. Each of the hollow metal sections 22–22(*e*) comprises an upwardly sloping inner metal base member 40 shaped to form a predetermined portion of the frusto-conical shape cover assembly 20; an outer metal covering member 42 spaced from and opposite and parallel to said inner metal base member; means 44 for joining the outer covering member to the inner metal base member and for defining a substantially enclosed space 46 between said spaced apart base member 40 and said covering member 42, with one or more outer liquid drain openings 48 being located at the lowermost portion of the enclosed space 46. With reference to FIG. 4, a plurality of spray means 50 are located within enclosed space 46 at predetermined locations adjacent to and spaced from said inner metal base member 40 for directing a spray of liquid coolant in the form of liquid droplets 52 against the inner metal base member in an amount sufficient to maintain an acceptable temperature in said elements heated by the furnace.

A liquid coolant supply header conduit 54 affixed at 56 within enclosed space 46 and extending across the inner metal base member 40 is provided for supplying liquid cooling to said spray means e.g. nozzles 50 which receive coolant from conduits 58 which communicate with header conduit 54.

A liquid coolant supply conduit 70, for supplying liquid directly and independently to each removable hollow metal section 22–22 (*e*) from a liquid coolant supply source 72 is located outside of enclosed space 46 and is connected to liquid coolant supply header conduit 54 within enclosed space 46. At least one liquid coolant drain conduit 80 is located adjacently outside of said enclosed space and in communication with one or more drain openings 82 for receiving and evacuating a flow of liquid coolant 87 from inside of enclosed space 46. Support member 24 is affixed to the lower portion 86 of the hollow metal section to removably engage the circular peripheral sidewall 28 of the metallurgical furnace 10.

Figure 1A:
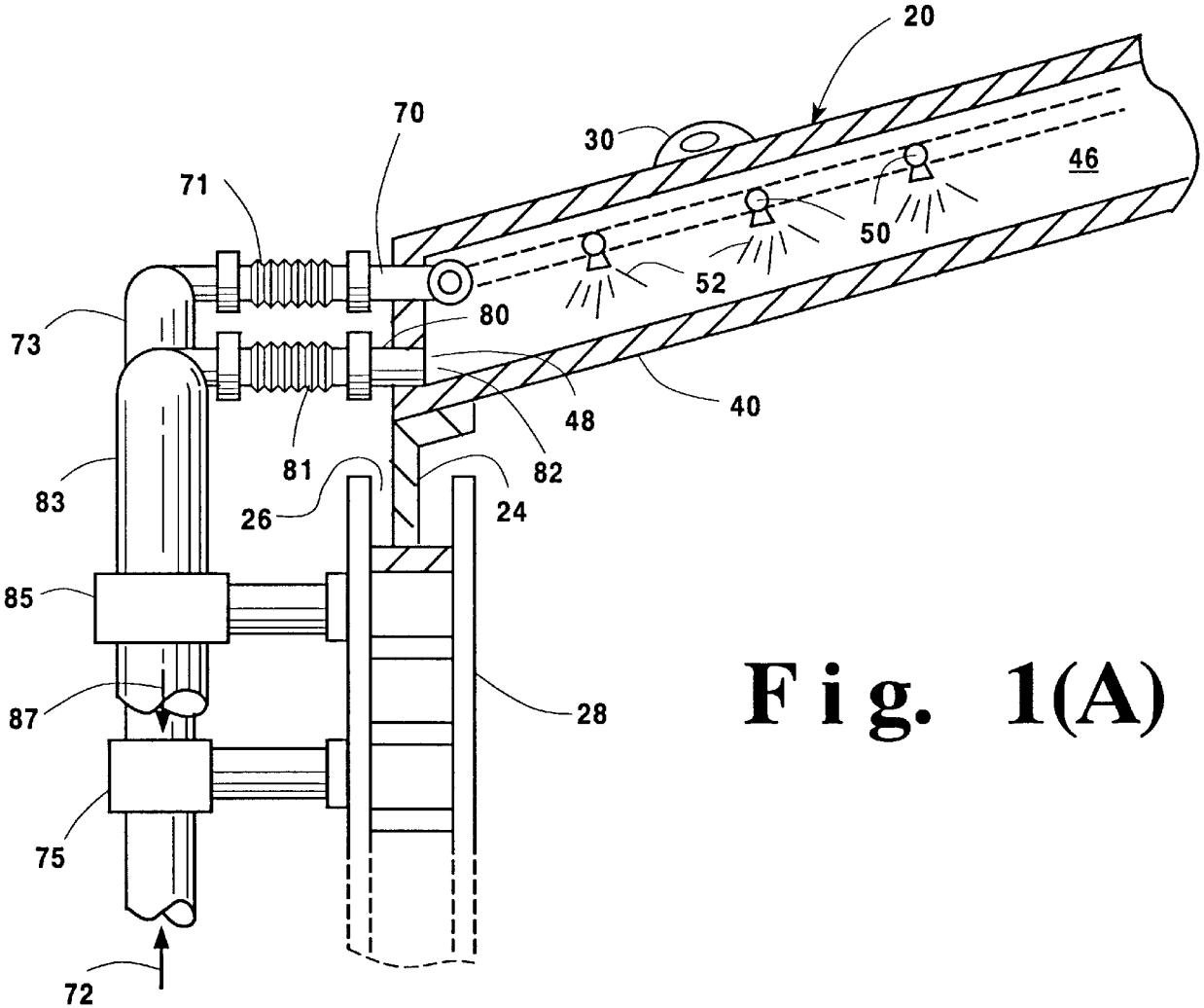
FIG. 1(A) is a fragmentary elevation view of a portion of the roof assembly of FIG. 1.

As shown in FIG. 1(A), liquid coolant supply conduit 70 is releasably coupled to flexible hose 71 which in turn is connected to a coolant supply pipe 73. Coolant supply pipe 73 is fixed to furnace sidewall 28 at bracket 75. Similarly, coolant drain conduit 80 is releasably coupled to flexible hose 81 which in turn is connected to a coolant drain pipe 83 which is also fixed to furnace sidewall 28 at bracket 85. This arrangement, which is provided for each of the hollow metal sections 22–22(*e*), enables rapid and convenient installation and removal of the hollow metal sections 22–22(*e*).

Figure 2:
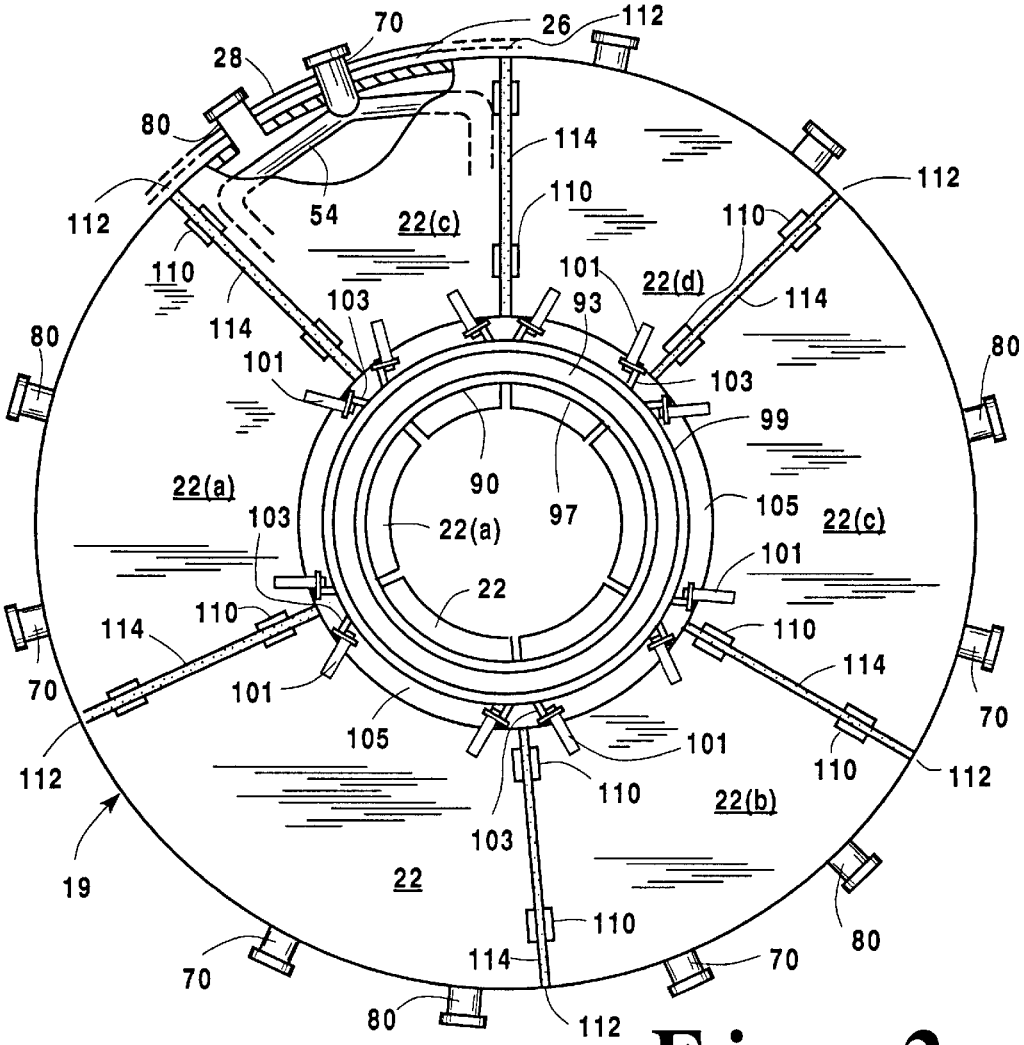
FIG. 2 is a plan view of a roof assembly in accordance with the present invention.
Figure 2A:
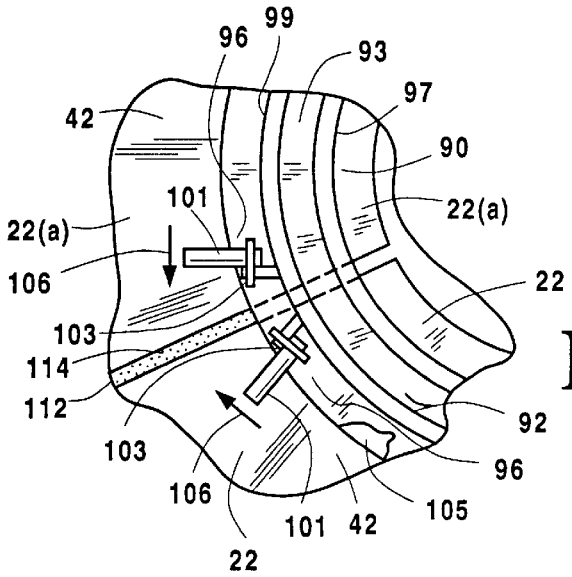
FIG. 2(A) is a fragmentary view of a portion of the roof assembly of FIG. 2.
Figure 3:
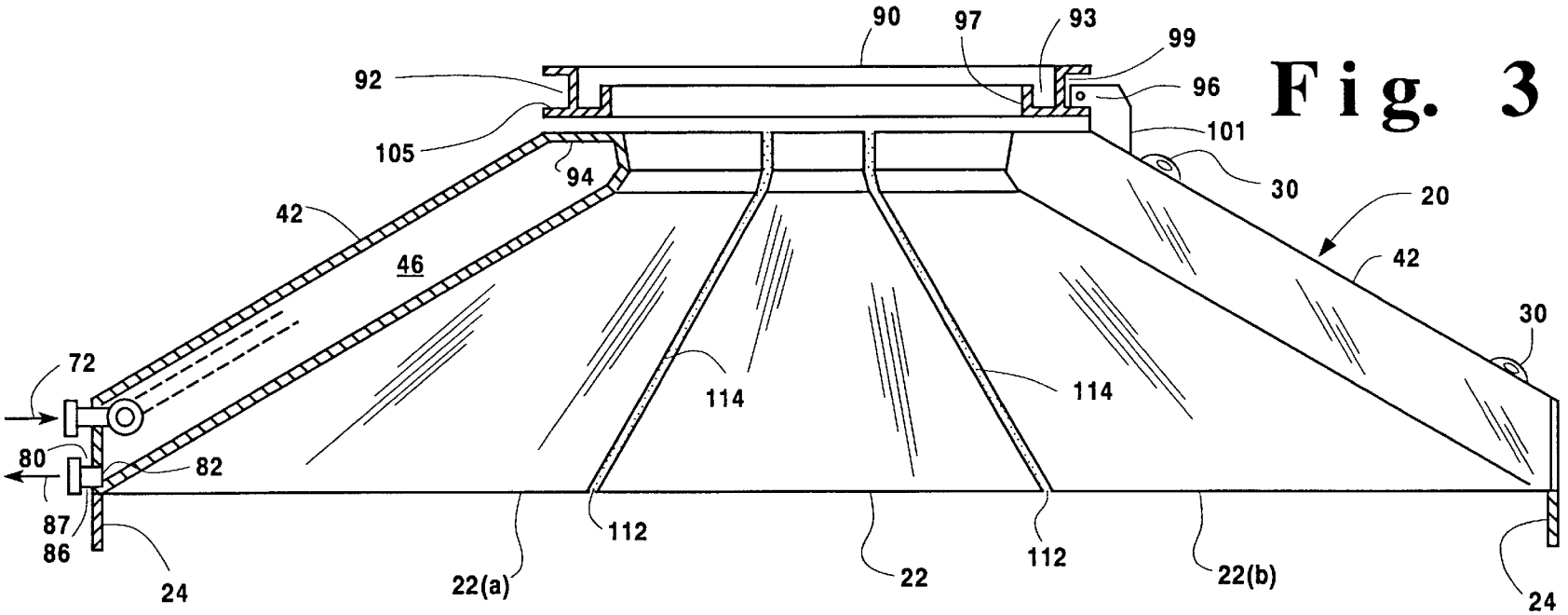
FIG. 3 is an elevation view of the assembly of FIG. 2.

With reference to FIG. 3, spray cooled roof assembly 20 is provided with a metal ring-shaped member 90 having an upwardly extending sidewall 92 is positioned above the level uppermost portion 94 of a hollow metal section 22–22 (*e*) and each outer metal covering member 42 of metal sections 22–22(*e*) is removably engaged, as indicated at 96 to the sidewall 92 of the metal ring-shaped member 90 and exerts a compressive force thereon. As shown in FIG. 2 and 2(A) bracket 101, affixed to the outer metal covering member of hollow metal section 22–22(*e*), is coupled to bracket 103 affixed to bottom flange 105 of metal ring-shaped member 90 which has an annular channel 93 defined by vertical channel sidewalls 97, 99, and compressive forces 106 are applied to ring-shaped member 90 with the result that all of the hollow metal sections 22–22(*e*) receive vertical support from coaction with ring-shaped member 90 and cantilever support is not needed. The hollow metal sections 22–22(*e*) are installable and removable as above-described in connection with FIG. 1. The annular channel 93 of ring shaped member 90 can be used to support conventional removable 'delta' ring, e.g. as shown at 11 in FIG. 1, and provide a means of sealing the furnace around the ring by the use of ceramic fiber and sand.

The hollow metal sections can be removably clamped together as shown at 110 in FIG. 2 and the joints 112 can be sealed, e.g. with heat resistant fabric and sand as indicated at 114.

Figure 3A:
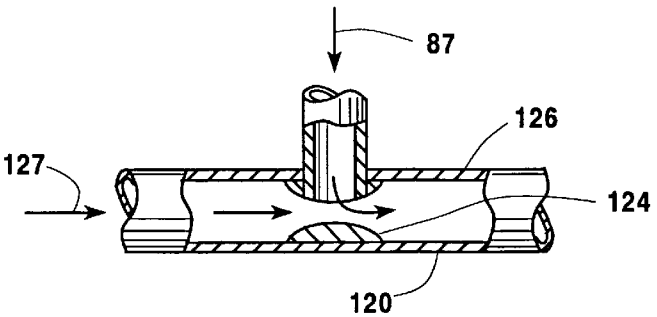
FIG. 3(A) is venturi type pump which can be used in conjunction with the roof assembly of FIG. 3.

As shown in FIG. 3(A), a pump means 120 comprising a venturi 124 in pipe 126, which conveys waste water 127 away from another area of the furnace, can be used to receive and evacuate spent liquid coolant 87 from hollow metal sections 22–22(*e*).

What is claimed is:

1. An upwardly sloping cover assembly of frusto-conical shape for a submerged arc metallurgical furnace having a circular peripheral sidewall for enclosing a metallurgical charge including a metal bearing ore, comprising a plurality of separate removable closely adjacent, hollow metal sections which define an inner opening through which an electrode can pass vertically downward into said metallurgical furnace, the lower portions of the hollow metal sections defining an outer periphery of the cover assembly which is supported by the circular sidewall of the submerged arc furnace, wherein each of said removeable hollow metal sections comprising:

(a) an upwardly sloping inner metal base member shaped to form a predetermined portion of the frusto-conical shape cover assembly;

(b) an outer metal covering member spaced from said inner metal base member;

(c) means for joining the outer covering member to the inner metal base member and for defining a substantially enclosed space between said spaced apart base member and said covering member with a plurality of outer liquid drain openings being located at a lower portion of the enclosed space;

(d) a plurality of spray means located within said enclosed space at predetermined locations adjacent to and spaced from said inner metal base member for directing a spray of liquid coolant in the form of liquid droplets against the inner metal base member in an amount sufficient to maintain an acceptable temperature in said inner metal base member;

(e) a liquid coolant supply header conduit affixed within said enclosed space and extending across the inner metal base member for supplying liquid cooling to said spray means;

(f) a liquid coolant supply conduit for supplying liquid directly and independently to said removable metal section from a liquid coolant supply source, which is located outside of said enclosed space, to said liquid coolant supply header conduit within said enclosed space;

(g) at least one liquid coolant drain conduit located adjacent outside of said enclosed space and in communication with said drain openings for receiving a flow of liquid coolant from inside of said enclosed space;

(h) a support member affixed to the lower portion of the hollow metal section to removably engage the circular peripheral sidewall of the metallurgical furnace; and (i) means for providing vertical support for the hollow metal section.

2. Cover assembly in accordance with claim 1 wherein pump means are provided in communication with said liquid coolant drain conduit for positively removing liquid coolant from the hollow metal section.

3. Cover assembly in accordance with claim 2 wherein said pump means comprises a venturi.

4. Cover assembly in accordance with claim 1 wherein the peripheral sidewall of the metallurgical furnace is provided with an open-top channel and the support member affixed to the lower portion of the hollow metal section rests in said channel.

5. Cover assembly in accordance with claim 1 wherein a metal ring-shaped member having an upwardly extending sidewall is positioned above the uppermost portions of the hollow metal sections and each hollow metal section is removably engaged to the sidewall of the metal ring-shaped member and exerts a compressive force thereon.

6. Cover assembly in accordance with claim 1 wherein a rotatable cantilever support arm engaged to the sidewall of the furnace is provided for the support of each hollow metal section.

* * * * *